US005309403A

United States Patent [19]

Bartow

[11] Patent Number: 5,309,403

[45] Date of Patent: May 3, 1994

[54] MODULAR CONTINUOUS FLOW PAINT DELIVERY SYSTEM

[75] Inventor: Douglas H. Bartow, Waterford, Mich.

[73] Assignee: Complete Automation, Inc., Lake Orion, Mich.

[21] Appl. No.: 728,201

[22] Filed: Jul. 10, 1991

[51] Int. Cl.[5] ..... B05D 1/02; B05C 21/00; B05B 7/32

[52] U.S. Cl. ..... 366/136; 366/153; 366/154; 366/159; 137/392; 137/572; 239/124

[58] Field of Search ..... 366/131, 136, 137, 138, 366/150, 152, 153, 154, 155, 159, 132, 290, 291; 239/127, 124, 148; 118/693, 602, 603; 137/563, 392, 571, 572, 566, 567

[56] References Cited

U.S. PATENT DOCUMENTS

| | | | |
|---|---|---|---|
| 2,582,802 | 1/1952 | Terrell, Jr. | 366/136 |
| 3,181,549 | 5/1965 | Perry, Jr. | 137/392 |
| 3,279,379 | 10/1966 | Klyce | 137/392 |
| 3,326,815 | 6/1967 | Werner et al. | 366/136 |
| 3,348,774 | 10/1967 | Wiggins | 239/70 |
| 3,377,987 | 4/1968 | Juvinall et al. | 118/626 |
| 3,605,683 | 9/1971 | Wiggins | 118/8 |
| 3,671,142 | 6/1972 | Calabrese | 137/392 |
| 3,989,003 | 11/1976 | Fagan et al. | 118/2 |
| 4,362,124 | 12/1982 | Fleig | 118/698 |
| 4,390,126 | 6/1983 | Buchholz et al. | 239/124 |
| 4,413,788 | 11/1983 | Schaefer et al. | 239/703 |
| 4,483,271 | 11/1984 | Eidschun et al. | 118/698 |
| 4,955,723 | 9/1990 | Schneider | 366/153 |
| 5,058,805 | 10/1991 | Anderson et al. | 239/124 |
| 5,063,874 | 11/1991 | Dodds et al. | 118/602 |

*Primary Examiner*—Harvey C. Hornsby
*Assistant Examiner*—Reginald L. Alexander
*Attorney, Agent, or Firm*—Basile and Hanlon

[57] ABSTRACT

The system includes a first module having a paint mixing and storage tank at a list location remote from any paint application point of use. The first module includes a remote pump for delivering paint at a first pressure from the tank to a local atmospheric pressure receptacle disposed at a second location in general proximity with paint application points of use. Excess paint delivered to the local receptacle is returned to the tank at the remote location. A secondary module includes a local pump to draw paint from the local receptacle for discharge into a main paint supply header at a third pressure. At least one separate and independent branch paint supply line is taken from the header for each spray booth, or groups of spray booths if located physically in close proximity to one another. Each of the branch lines is returned separately and independently through a back pressure control valve to the local atmospheric pressure receptacle. The first pressure is sufficient to supply paint to an atmospheric pressure storage receptacle disposed at the second location and is less than a second hypothetical pressure sufficient to supply paint to a furthermost desired point of paint application directly from the paint mixing and storage tank at the first location and at a predefined minimum paint application pressure. The third pressure is sufficient to supply paint to at least one desired point of paint application with the desired minimum paint application pressure and is less than the second hypothetical pressure.

18 Claims, 3 Drawing Sheets

MODULAR CONTINUOUS FLOW PAINT DELIVERY SYSTEM

FIELD OF THE INVENTION

This invention involves a method of applying paint to a vehicle, such as an automobile, truck, military vehicle and/or parts of such vehicles. The invention also relates to a paint circulation system for delivering paint from a remote location, such as an explosion-proof building, to a secondary location, where the paint is actually applied to the vehicles or parts. More particularly, the present invention relates to a modular continuous flow paint delivery system which reduces the pressure and the volume required to transfer the paint from the remote location to the application area.

BACKGROUND OF THE INVENTION

In today's market the consumer is aware of quality and the benefits of purchasing a quality product. Quality combined with a reasonable or competitive price of a product creates value. The paint finish of particular vehicles, such as passenger cars or trucks, plays a major role in convincing a potential customer that quality of the product is good. If the aesthetic quality of the product is easily inspected by a customer and is satisfactory, the customer often assumes that the entire product must be of the same quality level.

To obtain a high quality process, the paint application industry resorts to the use of sophisticated and newly-developed equipment for applying and processing the paint finish. The research, development and marketing of some equipment areas have accelerated to meet the need for higher quality paint finishing, such as robotic applicators which were recently made more accurate by the use of improved electric robots in lieu of the prior hydraulic robots or manual spray persons, intelligent conveyor systems which locate the object to be sprayed more precisely for the automatic spray equipment, the use of flexible products and infra-red ovens which can cure or dry the paint applied to these products without melting the substrate, etc. An area which has not accelerated in the paint application process is the paint circulation system to deliver paint in large paint application processes. The current technologies are not geared toward the paint products themselves, many of the paint products have been newly-developed to meet environmental issues, for example, water based paint products.

The current technologies of paint circulation systems are not geared toward efficiency and are not cost-effective with respect to operating expenses. The current designs are expensive to initially purchase and install. The current designs are also complex and difficult to operate in the manner necessary to keep the same parameters of the system on a daily basis which is required to achieve consistent quality levels. The current designs also require large volumes of hazardous materials to be used and disposed of annually to clean the system.

The following describes a typical previously-known paint circulation system. For instance, in a high-volume paint application process, vehicles or parts thereof travel through various spray booths or enclosures by means of a conveyor system. As these parts travel past the paint application equipment, the parts are coated with the appropriate paint products and paint colors. Often times several different colors are applied at the same spray booth with the same application equipment throughout the course of the day or even within a single 30 minute time period. In many paint application processes, a vehicle passing through the booth will be painted one color, while the vehicle next in line is to be painted a different color and the vehicle after that is to be painted yet another color and so on. To accomplish this task efficiently all necessary paint colors are circulated to these spray booths and remain available for use. Each color has its own system and piping network. At each application point in the spray booth, each piping network has an outlet port connected to an automated valve, which in turn is connected to a manifold typically called a "color change valve stack". Also connected to this color change manifold is a purge or cleaning solvent. By automatic sequencing, a single valve is opened on this manifold and the related color is provided to the application equipment and thus applied to the vehicle or part. Upon completion of painting that vehicle a specific color, the valve is automatically closed and the cleaning solvent valve is opened to rinse out the last color in preparation for the next vehicle color to be applied. As the next vehicle passes by the application equipment, the next appropriate color valve is opened to paint the new color. This automatic sequence is commonly referred to as a "color change". This procedure allows painting vehicles passing through the spray booths closely together to be different colors without the need to stop the conveyed vehicles to manually clean application equipment.

To make all paint colors available to all spray booths and equipment at all times, each color is contained in a paint circulation system. As high volumes of various colors of paint are used, the requirement to contain large volumes of product on site exist. These paint products range with respect to hazardous material ratings from classifications of combustible, which is typical for waterborne paint products, to flammable liquids, which is typical for solvent-based products. For safety reasons, these large volumes of material are stored and supplied from an environment which has specific safety guidelines to protect personnel and the facilities. As mentioned, the products are stored and supplied from this specific location known in the industry as a "paint mix room or building".

Some of the requirements to keep this paint mix building safe are: all electrical equipment is explosion-proof rated, all electrical power sources are installed in an explosion-proof class enclosure, grounding mats are installed to prevent static electricity, fresh air is circulated constantly, explosion-proof walls are constructed and blow out or relief panels are installed in case of an actual explosion, exotic fire extinguishing equipment is usually installed, spark-proof floors are provided, relative humidity is controlled to 50% or above which requires relative humidification equipment, and several other considerations must be in effect to meet the codes concerning hazardous environments. It is for this reason that the paint products are stored in a specific or centralized location. Explosion-proof relief systems are designed to relieve building pressure in the event of an explosion by actually allowing these relief panels to blow off and become detached from the remaining portion of the building. For this reason the paint mix building is located on an outside wall of the main facility, or may even be totally separate from the main facility. The paint mix building is therefor usually a great distance from the various paint spray booths where the paint is to be applied to the vehicle or parts. The fact that the paint spray booths are typically scattered throughout the manufacturing and painting facilities further increases this distance. Furthermore, the spray booths are generally quite long and each booth is located some distance apart from each other.

In the past, a paint circulation system for plants which require several colors to be available at the application areas would result in the following type of paint circulation system. Each color would be contained in its own tank at a pumping station located in the paint mix room. Paint material would be piped through piping, usually stainless steel, the long distance from the paint mix building to the paint spray booth application areas. After arriving at the paint spray booths the piping circles each spray booth to provide paint to application equipment on each side of the spray booth for each applicable booth. This piping is typically called the "high pressure supply line". After this high pressure supply line has provided paint to the most remote spray booth application points, this piping returns to the tank in the paint mix building. This piping is typically referred to as the "high pressure return line". Just prior to entering the tank, a back pressure regulator, or flow control device, is used to adjust the volume of paint returning. This controls the velocity inside of the circulating paint line. Paint products are circulated at predetermined speeds or velocities to keep by-products from separating from the mixture. The industry standard for paint velocity circulated within a pipeline is 60 feet per minute.

To ensure circulation of paint products in all areas of the circulation system, such as the station drop tubes to each actual application equipment or manual spray station, various circulation system types or configurations have been used. Some system variations may add additional piping or equipment to the overall system, however, in all system variations supply and return main piping headers are required.

All types of prior known paint circulation systems which deliver paint from a remote paint mix room or building to various paint spray booths and application equipment use points have common equipment, such as supply and return pipe headers. The length of the continuous pipe header from the mix room to and around all applicable spray booths, and the return pipe header back to the mix room is extremely long. In many of today's installations in the automotive and other industries, this pipeline for each color exceeds one mile in length. The pumping station must provide enough pressure to satisfy the most remote application point from the paint mix building, sometimes referred to herein as a second pressure for comparison purposes. Due to the great distance and the viscosity of paint, this piping header must be large in diameter to decrease the amount of pressure loss experienced while conveying the paint through a pipeline of this distance. It is typical for this pipe header to be a two-inch diameter Schedule 5 pipe header or even larger. With this size pipe and having a pipe length in excess of one mile, the pump source may be required to pump paint at a pressure in the range of 250 pounds per square inch in order to maintain the desired industry standard velocity of 60 feet per minute minimum, and provide the required application spray pressure at the most remote paint application point. Therefore, the larger the paint high pressure supply header, the high pressure return header and, when applicable, the additional low pressure return header, the greater the volume of paint is required to maintain this velocity.

In summary, all types of previously known paint circulation systems require large diameter piping to reduce pressure drop and large volumes of paint supplied to the piping to meet minimum velocity requirements. The end result of these requirements can be summarized as five problem areas. First, these prior known systems create quality problems related to the paint application process. Second, the initial purchase price of these large size components and piping are expensive, and the installation labor cost to install a large and heavy system is expensive. Third, operational cost of these large systems is extremely expensive. Fourth, these large systems generate an enormous amount of hazardous waste, and therefore create environmental concerns, in addition to the economic concerns associated with disposing of hazardous waste. Fifth, these large systems are difficult to control in a manner that will produce the high quality finished product desired by present-day manufacturers.

SUMMARY OF THE INVENTION

It is desirable in the present invention to overcome, or at the very least, reduce, the problems perceived to be associated with the prior known paint circulation systems. Therefore, it is desirable in the present invention to create a modular paint circulation system, where the minimum paint application pressure required at the spray booth is not generated from the paint mix room or paint mix building location, since generating the paint application pressure from the paint mix room requires the second pressure as discussed above. However, the paint product will still be supplied from the paint mix building, but at a lower pressure, sometimes referred to herein as a first pressure. It is further desirable in the present invention to provide paint pressure required for the actual spray painting process from a single area centrally located with reference to the applicable paint spray booths, sometimes referred to herein as a third pressure. Furthermore, it is desirable in the preferred embodiment of the present invention to supply paint to each applicable spray booth in modular form so as to make possible a structure which is easily adaptable to changing paint booth requirements, for example the addition of a new paint spray booth without removing and resizing any of the existing paint supply and return pipeline from the remote paint mix building to the local paint spray booth, or without removing or resizing any of the existing local piping around the paint spray booth. It is also desirable in the present invention to reduce the system pressure drop by supplying paint to each applicable spray booth from a single supply manifold originating at the single centrally located area. The local modular system initiates the paint product supply from a centrally located single supply source, so that each spray booth, or in some cases, spray booth groups, can be supplied by at least one separate branch from this supply manifold to and around a specific spray booth or spray booth group. After all application equipment stations have been serviced for that booth, this branch line will become the return line and continue back to the central location supply source, where the return line, or return lines are each fitted with a back pressure regulator and then terminate into the atmospheric pressure local storage vessel. It is desirable in the present system to greatly reduce the volume of paint required to be circulated to maintain the 60 feet per minute minimum velocity by reducing the pipe size of all concerned headers and manifolds, which subsequently reduces all component size requirements. By reducing all component size requirements, the initial investment, equipment procurement and installation is greatly reduced. In addition, the operating cost for smaller components also translates into a savings in the required utilities. Furthermore, the smaller component size greatly reduces the amount of paint inventory within the pipeline, which produces a corresponding operational expense savings by greatly reducing the amount of paint that is scrapped during changeover and any refitting of the paint circulation system to changing requirements at the individual spray booth locations within the manufacturing and painting facilities.

The prior known paint circulation systems commonly require 900 to 1300 gallons of paint for each of the 18 colors that are typically provided. At a cost of $50.00 to $60.00 per gallon, the paint in the pipeline of prior known paint circulation systems can represent an investment of up to $1,400,000.00 or more. This paint inventory is normally disposed of as waste, along with the solvent used to flush the paint from the system, whenever booths are added to the production line or whenever a particular paint color is replaced with a new one. The present invention reduces the amount of paint inventory held in the pipelines by approximately 90%. This is accomplished as a result of downsizing components of the system, particularly pipeline size, which in turn is possible due to the modular or satellite design of the present invention. The primary or remote module is designed to function only as a transfer pump, line and main storage tank. The function of supplying adequate paint application pressure to the most remote paint application point is designed into the secondary or local module or satellite. By splitting these two functions into different modules, the 900 to 1,300 gallons per color of paint in the piping can be reduced typically to between 90 to 130 gallons of paint per color line. This represents an initial savings of over $1,000,000.00 when starting the paint line with corresponding savings in cleaning and disposal costs every year during model changeovers. In addition, the installation cost, including labor and materials, is generally ¼ of the cost of installinq the prior known systems. The remote paint storage tank size in the present invention is typically 200 to 300 gallons, and each local or satellite paint receptacle is typically one-tenth that size or approximately 25 gallons.

The present invention provides a system which is versatile enough to satisfy characteristics of virtually all paint type products and rheologies of solvent-based paints and waterborne paints regardless of whether the waterborne paint is thixotropic or stable viscosity types of technologies. This becomes of increasing importance when it is understood that most systems being installed today are for the purpose of, or will in the future potentially be used for, handling waterborne paint products. Due to the characteristics of waterborne paints, one being that it is highly corrosive by nature, all components and piping in these installations are high purity stainless steel which add enormous cost factors to the materials and installation methods. Therefore, in these instances, reducing component size and piping size further reduces capital investment by a larger margin than would be experienced in comparison to a solvent-based paint circulation system which was typically constructed of black iron, piping and mild steels.

The modular continuous flow paint delivery system of the present invention includes a first or primary paint circulating module having a mixing and storage tank located remote from any spray paint booth or paint application point of use, pump means for delivering paint from the remote paint mixing and storage tank to a local receptacle at atmospheric pressure at a satellite location local to, or in proximity with, the spray paint booths and paint application points of use to be supplied with paint. Primary paint return means is provided to return paint from the satellite or local location to the remote location. The primary paint return means may include either a return pump means for pumping paint from the local receptacle back through the same pipeline to the paint mixing and storage tank, or for pumping the paint through a second return pipeline from the local receptacle to the paint mixing and storage tank, or merely a continuous recirculating line from the paint mixing and storage tank to the local receptacle and returning to the paint mixing and storage tank powered by the remote pump means. The first paint circulation module being used to transfer paint from the remote paint mix room or building to one or more locations generally in proximity to the spray booths or other paint application point of use. The paint circulates by the remote pump means to keep one or more local receptacles filled to within predefined limits. The level of paint within each local receptacle being controlled by appropriate automated control valves. In addition, the paint circulated by the remote pump means preferably is maintained at the industry standard of 60 feet per minute velocity while allowing greatly reduced pipe diameter and correspondingly reduced pump size. This is possible, because the first paint circulation module is not sized to directly feed all of the various individual points of paint application, but rather is used merely to fill one or more local receptacles which are centrally located with respect to the various points of paint application. This greatly reduces the maximum paint flow requirements, without any adverse affect on the system operation.

The modular continuous flow paint delivery system of the present invention also includes a second paint circulation module, or secondary module, having the previously-mentioned local receptacle and local pump means for delivering paint from the local receptacle through any desired filter means and optional heat exchanger means to at least one separate individual branch line or supply line for each separate spray booth line or group. Each individual supply line having its own separate independent return line to the local receptacle. This configuration maintains the small size of the piping throughout the paint distribution system and furthermore simplifies the steps necessary in order to add additional separate individual supply lines for new spray booths to be added to the system in the future. Each separate individual return line having a back pressure regulator prior to termination in the local receptacle at atmospheric pressure.

It is believed that most applications can be designed to function properly with pipe sizes of 1 inch diameter or less in both the first and second paint circulation modules. Optional equipment in the present invention would include a second remote pump means in the first paint circulation module for returning paint from the local receptacle to the paint mixing and storage tank through the same pipeline.

Other objects, advantages and applications of the present invention will become apparent to those skilled in the art of paint distribution systems when the following description of the preferred embodiment contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 3:
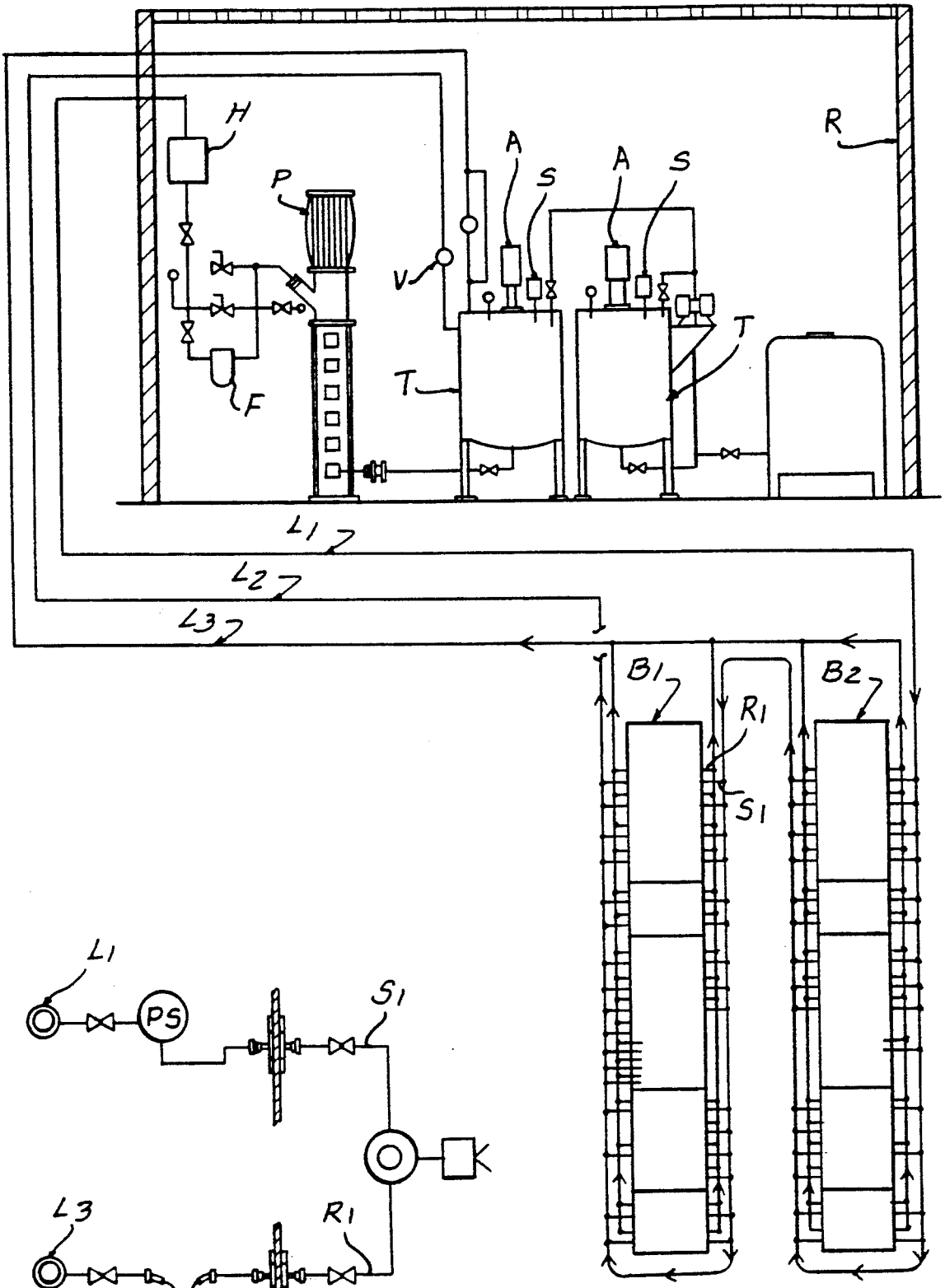
FIG-3 PRIOR ART
FIG. 3 is a schematic diagram of a prior known three-pipe paint distribution system.
Figure 4:
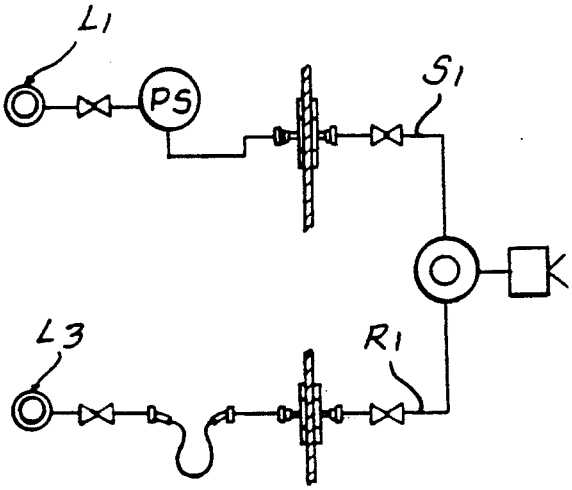
FIG-4 PRIOR ART
FIG. 4 is a schematic diagram of a paint drop supply and return line.

Referring first to FIGS. 3 and 4, a previously known three-pipe distribution system is depicted therein. As previously indicated, this previously known system typically includes a large axial paint circulation pump P, which is very expensive to purchase and operate. The pump P draws paint from a paint mixing and storage tank T. The storage tank T preferably includes a mixer or agitator A and level sensor S. The pump P discharges the paint preferably through a paint filter element F and heat exchanger H into the high pressure supply line L1 at a pressure, sometimes referred to herein as a second pressure, sufficient to supply paint to a furthermost point of paint application with a minimum paint application pressure. The high pressure supply line L1 leaves the explosion proof building or room R and passes into the manufacturing and painting facility areas to spray booth or line locations, B1 and B2. The high pressure supply line L1 is disposed around the outer peripheries of the spray booths B1 and B2 in serpentine manner providing access for drop supply lines to the various paint application equipment stations along each side of the longitudinal length of the spray booths B1 and B2. The high pressure supply line then becomes the high pressure return line L2 for recirculating unused paint from within the high pressure supply line L1 back to the paint mix and storage tank T. At each paint application equipment station, a paint drop supply line is provided from the high pressure supply line L1. The drop supply line passes through the bulkhead fitting of the paint spray booth, either B1 or B2, to supply the color change valve. To prevent paint from separating or settling in the drop supply line S1 due to lack of flow when that particular color is not activated by the color change valve, a drop return line R1 is connected between the color change valve and a low pressure return line L3. The high pressure and low pressure return lines, L2 and L3 respectively, typically pass through a back pressure regulator to control the flow of paint in the return and supply lines prior to discharge into the paint mix and storage tank T.

Figure 1:
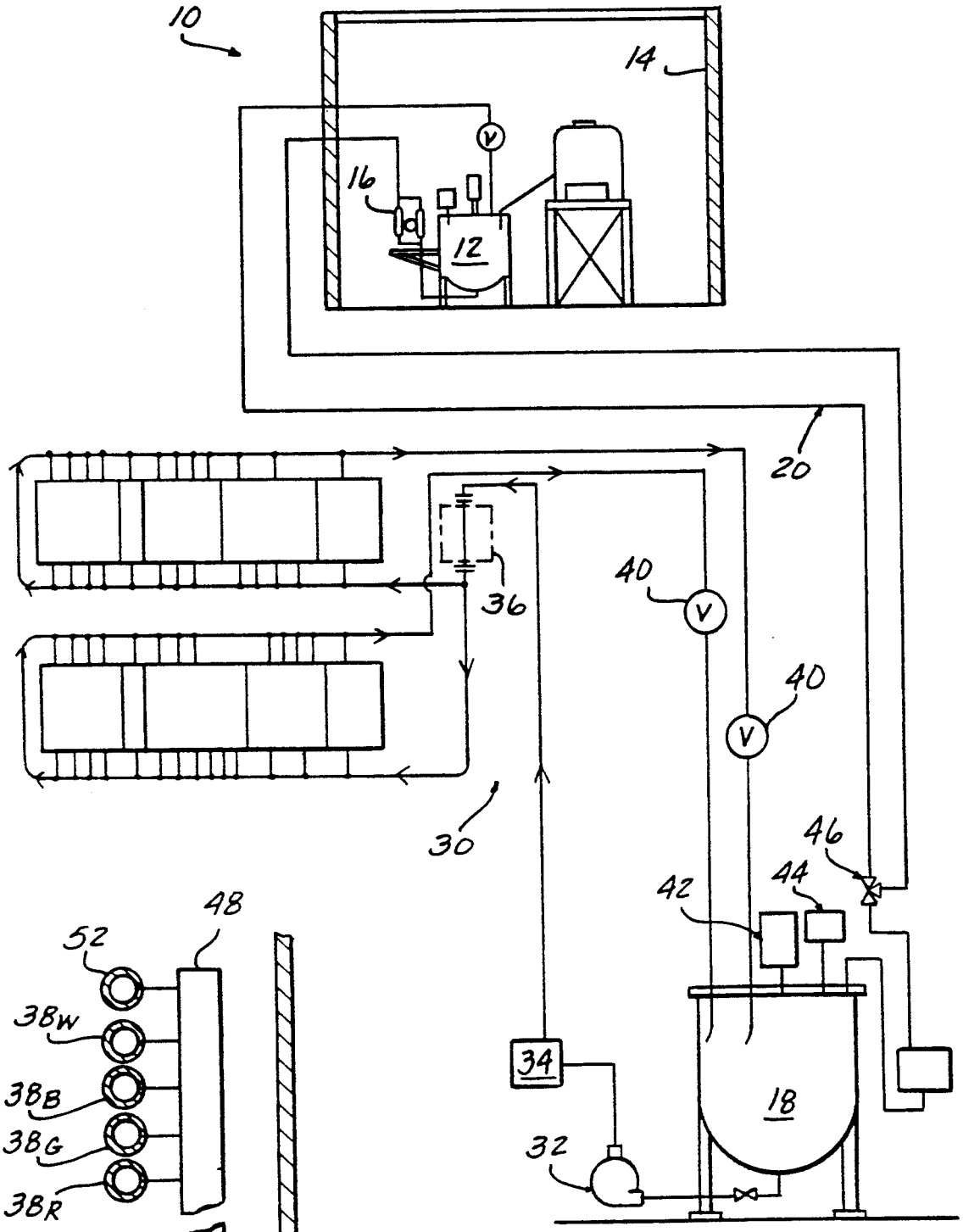
FIG. 1 is a schematic view of a modular continuous flow paint delivery system according to the present invention.
Figure 2:
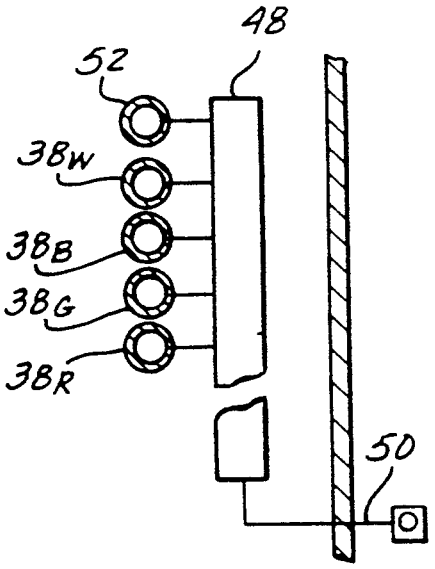
FIG. 2 is a schematic diagram of color change valve piping at a paint application equipment station.

Referring now to FIGS. 1 and 2, the present invention greatly simplifies the paint distribution system in comparison with previously known distribution systems. This is accomplished by dividing the paint distribution system into several interactive modules. Each module performs only a part of the function previously performed by the previously known paint distribution systems. However, in doing so an economy of smaller scale is achieved that was not heretofore realized as being possible. The first or primary paint circulation module, designated generally as 10, includes a paint mixing and storage tank at a location remote from any spray paint booth or paint application point of use. The paint mixing and storage tank 12 generally being located in a separate mixing room or building 14. The first module 10 also includes remote or first pump means 16 for delivering paint at a first pressure from the remote paint mixing and storage tank 12 to a, preferably centrally located, satellite or local receptacle 18 disposed at a second location local to, or in general proximity with, the spray paint booths or paint application points of use to be supplied with paint. The first paint circulation module 10 further includes primary paint return means 20 for recirculating paint from the second local location back to the first remote location for reintroduction into the paint mixing and storage tank 12 disposed in the remote paint mix room or building 14.

In the first embodiment of the invention, the primary paint return means can include a continuation of the paint pipeline header from the remote pump means 16 through an automated directional control valve operated in response to level sensing equipment disposed within the local receptacle 18 for refilling the receptacle 18 as required, and for continuously returning paint to the remote paint mixing and storage tank 12 through the recirculating paint pipeline header, even during required filling of receptacle 18. An alternative embodiment of the present invention would provide third pump means 22 for drawing paint from the local receptacle 18 for discharge back to the remote paint mixing and storage tank 12. This configuration may be desirable when the pipe length between the remote and local locations is an excessively long distance for a single recirculating pipeline from the remote location to the local location and back. In another embodiment, the third pump means 22 may be cycled by appropriate control means to pump paint from the local receptacle 18 back to the remote paint mixing and storage tank 12 through the same header as it was supplied through originally, by cycling the remote pump means 16 and the third pump means 22 to oscillate fluid back and forth between tank 12 and receptacle 18 through a single pipeline. These alternative configurations can best be seen in FIGS. 5 and 6.

The present invention also includes at least one second paint circulation module, generally designated as 30, sometimes referred to herein as a satellite module or secondary module. The common piece of equipment between the first module 10 and the second module 30 is the local receptacle 18. The second module 30 also includes local or second pump means 32 for drawing paint from the local atmospheric pressure receptacle 18 and for circulating the paint at a third pressure past the various points of paint application. Paint discharged from the local or second pump means 32 enters a main paint supply header, which may include paint filtration means 34 and/or heat exchanger means 36. At least one separate independent branch paint supply line 38 supplies paint to each spray booth, or in particular circumstances group of spray booths. Each branch paint supply 38 separately and independently is returned to the local receptacle 18 through separate back pressure control valves 40. Preferably, the local receptacle 18 includes mixer or agitator means 42 and level sensing means 44. Level sensing means 44 is connected through appropriate control circuitry (not shown) to automate operation of control valve 46 to permit filling of the local receptacle 18 from the primary paint circulation module supply line when the level sensing means 44 detects a predetermined low level. As paint from the primary paint circulation module 10 fills local receptacle 18, level sensing means 44 will, at a predetermined full position, send the appropriate signal through the control circuitry to control valve 46 to reposition the valve into the recirculating only mode from the previously taken confined receptacle fill and recirculating mode.

Each paint color to be supplied to the various spray booths and paint application equipment point of use, would require at least one primary paint circulation module and one secondary or satellite circulation module 30. As seen in FIG. 2, the separate and independent branch paint supply lines 38 for each of the individual colors, for example, red $38_R$, white $38_W$, black $38_B$, yellow $38_Y$ and green $38_G$, would have piping runs in generally close proximity to one another, particularly in proximity to the connection to the color change valve 48. The color change valve 48 is connected to each of the respective branch paint supply lines 38 as schematically shown in FIG. 2. The equipment supply line 50 is then taken from the color change valve 48. As is conventional, a solvent flush supply line 52 is provided for cleaning the color change valve 48 and the connected equipment supply line 50.

Figure 5:
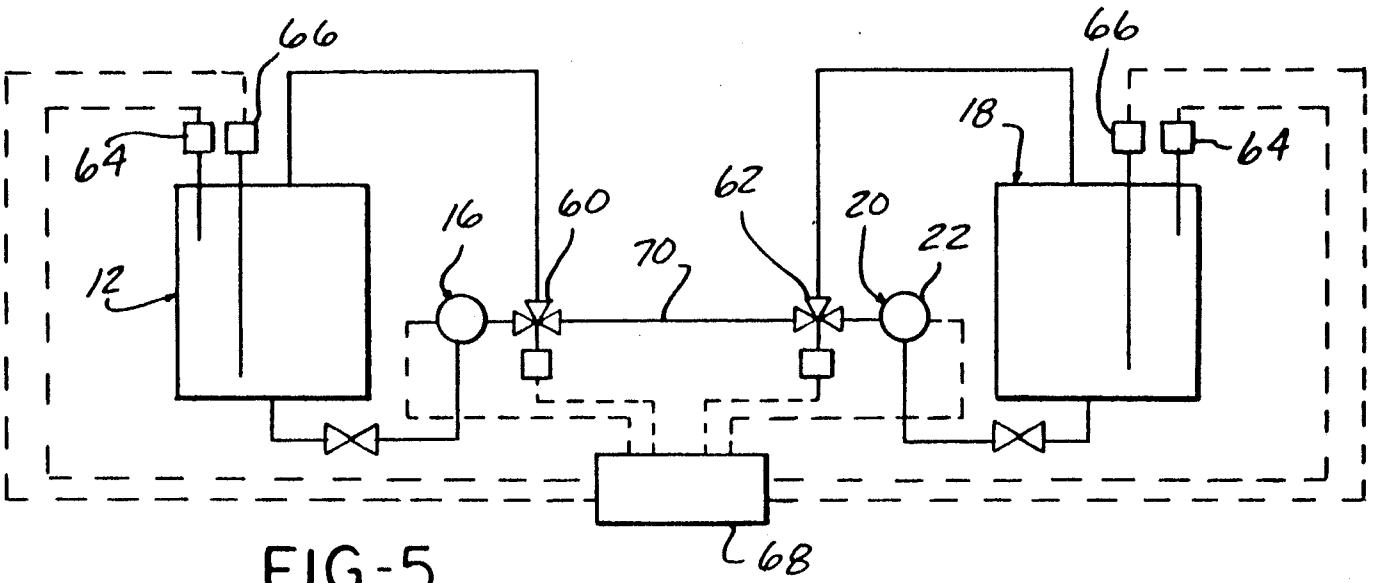
FIG. 5 is an alternative embodiment of the first or primary paint circulation module according to the present invention.

Referring now to FIG. 5, an alternative configuration for the first or primary module 10 is shown. As previously described, the primary paint circulation module 10 includes a remote paint mixing and storage tank 12 and remote or first pump means 16 for drawing paint from the tank 12 for delivery at a first pressure to one or more local atmospheric pressure receptacles 18 disposed at a different location. The primary paint circulation module 10 also includes primary paint return means 20. In this alternative embodiment, the primary paint return means 20 includes third pump means 22 and directional flow control valves 60 and 62. The directional flow control valves 60 and 62, are alternately actuated with the remote or first pump means 16 and third pump means 22 in response to signals from high level sensor means and low level sensor means, 64 and 66 respectively, disposed in tank 12 and receptacle 18. The high and low level signals are sent to control means 68 in order to control the oscillation of paint through the single paint transfer line 70 connecting the remote location with the local location. In operation, when remote pump means 16 is operating, directional flow control valve 60 is disposed to allow the paint to flow from the remote pump means 16 to the single paint transfer line 70 and directional flow control valve 62 is disposed to allow the paint to flow from the single paint transfer line 70 into the local receptacle 18. When the level of paint in receptacle 18 reaches the high level sensing means 64, remote or first pump means 16 is deactivated or switched to a recirculating mode back into tank 12, third pump means 22 is then energized or switched from the recirculating mode, and the orientation of directional flow control valves 60 and 62 is reversed. Directional flow control valve 62 is disposed in an orientation to allow paint to flow from third pump means 22 into single paint transfer line 70 and directional flow control valve 60 is disposed to allow paint to flow from the single paint transfer line 70 into the paint mixing and storage tank 12. Paint is then recirculated, or oscillated in this manner between the remote location and the local location in response to predetermined level settings in the local receptacle 18.

Figure 6:
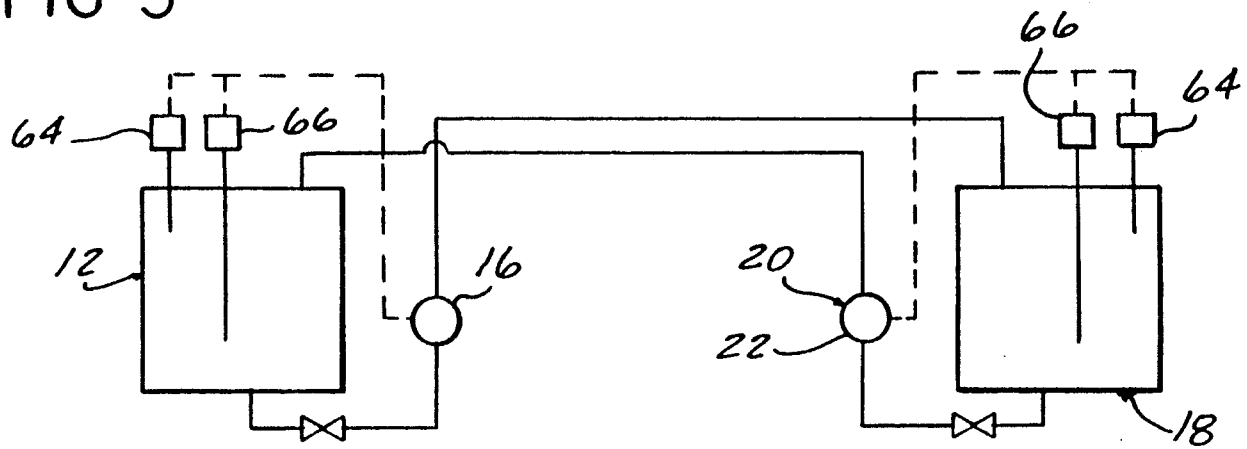
FIG. 6 is another alternative embodiment of the first primary paint circulation module according to the present invention.

Referring now to FIG. 6, another alternative embodiment is depicted for the first or primary paint circulation module 10. In this alternative embodiment of the present invention, the primary module 10 includes a remote paint mixing and storage tank 12 having high level and low level sensor means, 64 and 66 respectively, controlling remote or first pump means 16 for delivering paint from the tank 12 to the local receptacle 18. In this embodiment, the primary paint return means 20 includes third pump means 22 for drawing paint from the local receptacle 18 in response to control by the high level and low level sensor means, 64 and 66 respectively, for discharge into the paint mixing and storage tank 12 at the remote location. The secondary module 20 is not shown in FIG. 6, however, it should be clear that the appropriate piping and control connections would be made to the local receptacle 18 as previously shown in FIG. 1.

While the invention has been described in connection with what is presently considered the most practical and preferred embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation permissible under the applicable law so as to encompass all such modifications and equivalent structures.

What is claimed is:

1. A modular continuous flow paint delivery system for delivering paint from a first location generally remote from any desired point of paint application to a plurality of points of paint application at a predefined minimum paint application pressure comprising:

a first paint circulation module having a paint mixing and storage tank at a first location generally remote from any desired point of paint application, first pump mans for delivering paint from the paint mixing and storage tank to a second location generally in proximity with at least one desired point of paint application at a first pressure sufficient to supply paint to an atmospheric pressure storage receptacle disposed at said second location, said first pressure less than a second pressure sufficient to supply paint to a furthermost desired point or paint application directly from the first location at the predefined minimum paint application pressure and paint return means for returning excess paint from the second location to the paint mixing and storage tank; and a second paint circulation module having said atmospheric pressure storage receptacle disposed at said second location to receive paint delivered by the first pump means, second pump means for delivering paint from the atmospheric pressure storage receptacle to said at least one desired point of paint application at a third pressure sufficient to supply paint to said at least one desired point of paint application with the desired minimum paint application pressure, said third pressure less than said second pressure, main paint supply header means for receiving paint discharged from the second pump means, and at least one separate and independent branch paint supply line connected to the main paint supply header means for connecting to said at least one desired point of paint application, each branch paint supply line separately and independently returned to the atmospheric pressure storage receptacle through a back pressure control valve means for independently and selectively controlling the back pressure in each of the branch paint supply lines.

2. The system of claim 1 wherein the paint return means comprises:

third pump means for drawing paint from the atmospheric pressure storage receptacle for delivery to the paint mixing and storage tank.

3. The system of claim 1 wherein the paint return means comprises:

a single continuous recirculating pipeline from the first pump means to a directional flow control valve means for selectively switching between a combined atmospheric pressure storage receptacle fill and paint recirculation position, and a paint return only position to recirculate the paint from the first pump means back to the paint mixing and storage tank.

4. The system of claim 1 wherein the paint return means comprises:

third pump means for drawing paint from the atmospheric pressure storage receptacle for discharge to the paint mixing and storage tank;

a single paint transfer line connecting the first pump means to the third pump means;

first and second directional flow control valves disposed between the first pump means and the third pump means, the first directional control valve for selectively directing fluid flow from the first pump means to the single paint transfer line when in a first position, and for selectively connecting the single paint transfer line with the paint mixing and storage tank when in a second position, the second directional flow control valve means for selectively connecting the single paint transfer line with the atmospheric pressure storage receptacle when in a first position, and for selectively connecting the third pump means with the single paint transfer line when in a second position; and control means for selectively actuating said first pump means when the first directional flow control valve and the second directional flow control valve are in the first position to transfer paint from the paint mixing and storage tank to the atmospheric pressure storage receptacle, and for selectively actuating the third pump means when the first and second directional flow control valves are in the second position for transferring paint from the atmospheric pressure storage receptacle to the paint mixing and storage tank.

5. The system of claim 4 further comprising:

high level and low level sensor means disposed in the atmospheric pressure storage receptacle for signaling the control means when predetermined low and high level of paint are reached within the atmospheric pressure storage receptacle.

6. The system of claim 1 further comprising:

paint filter means disposed in said main paint supply header means for filtering contaminant particles from the circulating paint.

7. The system of claim 1 further comprising:

heat exchanger means disposed in the main paint supply header means for maintaining the paint at a predetermined temperature.

8. The system of claim 1 further comprising:

agitator means disposed in the atmospheric pressure storage receptacle for maintaining a thoroughly mixed paint volume.

9. A method for delivering paint from a first location generally remote from any desired point of paint application to a plurality of points of paint application at a predefined minimum paint application pressure comprising the steps of:

drawing paint from a paint mixing and storage tank disposed at the first location;

pumping the paint drawn from the paint mixing and storage tank with first pump means for discharge into a paint circulation pipeline at a first pressure sufficient to supply paint to an atmospheric pressure storage receptacle disposed at a second location generally in proximity with at least one desired point of paint application, said first pressure less than a second pressure sufficient to supply paint to a furthermost desired point of paint application directly from the first location at the predefined minimum paint application pressure;

receiving paint from the paint circulation pipeline in the atmospheric pressure storage receptacle disposed at the second location;

returning excess paint from the second location back to the paint mixing and storage tank at the first location;

drawing paint from the atmospheric pressure storage receptacle at the second location;

pumping the paint drawn from the atmospheric pressure storage receptacle with second pump means for subsequent pressurized discharge into a paint supply header at a third pressure sufficient to supply paint to said at least one desired point of paint application with the desired minimum paint application pressure, said third pressure less than said second pressure;

receiving the pressurized discharge of the second pump means in the paint supply header for connection to said at least one desired point of paint application;

branching at least one separate and independent branch paint supply line from the paint supply header for connection to said at least one desired point of paint application; and returning excess paint from each branch paint supply line independently and separately to the atmospheric pressure storage receptacle through a back pressure control valve means at the second location.

10. The method of claim 9 further comprising the step of:

returning excess paint from the atmospheric pressure storage receptacle to the paint mixing and storage tank with return pump means drawing paint from the atmospheric pressure storage receptacle for pressurized discharge into a return paint header.

11. The method of claim 9 further comprising the step of:

controlling a direction of paint flow discharged from the first pump means with a directional flow control valve means for selectively discharging paint into the atmospheric pressure storage receptacle while continuing recirculation when in a first position and for selectively only recirculating paint through the paint circulation pipeline when in a second position.

12. The method of claim 9 further comprising the steps of:

oscillating paint in first and second directions, the first direction of paint flow passing from the paint mixing and storage tank through first pump means and a first directional flow control valve disposed in a first orientation into a single paint transfer line and through a second directional flow control valve in a first orientation for discharge into the atmospheric pressure storage receptacle, and a second direction of paint flow from the atmospheric pressure storage receptacle through return pump means and the second directional flow control valve in a second orientation into the single paint transfer line and the first directional flow control valve in a second orientation for discharge into the paint mixing and storage tank.

13. The method of claim 12 further comprising the steps of:

controlling the oscillation of the paint in response to sensing a level of paint within the atmospheric pressure storage receptacle.

14. The method of claim 9 further comprising the step of:

filtering the paint discharged by the second pump means prior to entering the at least one separate and independent branch paint supply line.

15. The method of claim 9 further comprising the step of:

heating the paint discharged from the second pump means prior to entering the at least one separate and independent branch paint supply line.

16. The method of claim 9 further comprising the step of:

agitating paint within the atmospheric pressure storage receptacle to prevent settling.

17. A method for delivering paint from a first location generally remote from any desired point of paint application to a plurality of points of paint application at a predefined minimum paint application pressure comprising the steps of:

pumping paint drawn from a paint mixing and storage tank with first pump means for discharge at a first pressure sufficient to supply paint to an atmospheric pressure storage receptacle disposed at a second location generally in proximity with at least one desired point of paint application, said first pressure less than a second pressure sufficient to supply paint to a furthermost desired point of paint application directly from the first location at the predefined minimum paint application pressure;

returning excess paint from the second location back to the paint mixing and storage tank at the first location;

pumping paint drawn from the atmospheric pressure storage receptacle with second pump means for subsequent pressurized discharge at a third pressure sufficient to supply paint to said at least one desired point of paint application with the desired minimum paint application pressure, said third pressure less than said second pressure;

returning excess paint from said at least one desired point of paint application to the atmospheric pressure storage receptacle at the second location; and controlling a direction of paint flow discharged from the first pump means with a directional flow control valve means for selectively discharging paint into the atmospheric pressure storage receptacle while continuing recirculation when in a first position and for selectively only recirculating paint back to the paint mixing and storage tank at the first location when in a second position.

18. A modular continuous flow paint delivery system for delivering paint from a first location generally remote from any desired point of paint application to a plurality of points of paint application at a predefined minimum paint application pressure comprising:

a first paint circulation module having a paint mixing and storage tank at a first location generally remote from any desired point of paint application, first pump means for delivering paint from the pant mixing and storage tank at a first pressure sufficient to supply paint to an atmospheric pressure storage receptacle disposed at a second location generally in proximity with at least one desired point of paint application, said first pressure less than a second pressure sufficient to supply paint to a furthermost desired point of paint application directly from the first location at the predefined minimum paint application pressure, and paint return means for returning excess paint form the second location to the paint mixing and storage tank;

a second paint circulation module having said atmospheric pressure storage receptacle disposed at said second location to receive paint delivered by the first pump means, second pump means for delivering paint from the atmospheric pressure storage receptacle at a third pressure sufficient to supply paint to said at least one desired point of paint application with the desired minimum paint application pressure, said third pressure less than said second pressure, and second paint return means for returning excess paint from said at least one desired point of paint application to the atmospheric pressure storage receptacle; and a single continuous recirculating pipeline from the first pump means to a directional flow control valve means for selectively switching between a combined atmospheric pressure storage receptacle fill and paint recirculation position, and a paint return only position to recirculate the paint back to the paint mixing and storage tank.

* * * * *